United States Patent [19]

Hoffman

[11] Patent Number: 4,939,997

[45] Date of Patent: Jul. 10, 1990

[54] ARTICLE OF AMMUNITION

[75] Inventor: Dietrich Hoffman, Schramberg, Fed. Rep. of Germany

[73] Assignee: Mauser-Werke Oberndorf GmbH, Oberndorf, Fed. Rep. of Germany

[21] Appl. No.: 404,117

[22] Filed: Sep. 7, 1989

[30] Foreign Application Priority Data

Sep. 29, 1988 [DE] Fed. Rep. of Germany ..... 3833001

[51] Int. Cl.[5] ..... F42B 10/34

[52] U.S. Cl. ..... 102/503; 102/517; 102/520

[58] Field of Search ..... 102/484, 503, 517, 518, 102/520–523

[56] References Cited

U.S. PATENT DOCUMENTS

| | | | |
|---|---|---|---|
| 2,433,334 | 12/1947 | Birkeland | 102/503 |
| 3,498,222 | 3/1970 | Birkigt | 102/517 |
| 3,507,221 | 4/1970 | Grolly | 102/523 |
| 3,771,458 | 11/1973 | Schweinler et al. | 102/523 |
| 4,164,904 | 8/1979 | Laviolette | 102/503 |
| 4,384,528 | 5/1983 | Moore et al. | 102/503 |
| 4,436,035 | 3/1984 | Strandli | 102/503 |

FOREIGN PATENT DOCUMENTS

| | | |
|---|---|---|
| 3131540 | 8/1981 | Fed. Rep. of Germany . |
| 3508053 | 3/1985 | Fed. Rep. of Germany . |

*Primary Examiner*—Harold J. Tudor

*Attorney, Agent, or Firm*—Scully, Scott, Murphy & Presser

[57] ABSTRACT

Subcaliber ammunition, especially for utilization with cannon which are mounted on board aircraft, including a subcaliber projectile core and a propulsion mechanism. The propulsion mechanism is constructed as an inherently stable secondary projectile which flies at a readily estimatable trajectory. The propulsion mechanism continues to fly in the manner of a projectile subsequent to the separation thereof from the projectile core.

2 Claims, 2 Drawing Sheets

ARTICLE OF AMMUNITION

BACKGROUND OF THE INVENTION

1. Field of the Invention

The present invention relates to ammunition, especially for utilization with cannon which are mounted on board aircraft, including a subcaliber projectile core and a propulsion mechanism.

2. Discussion of the Prior Art

Ammunition of that type is described in the specification of German Patent No. 31 31 540. A propulsion mechanism which is constructed in the form of a sabot is interconnected with the subcaliber-sized projectile core through the utilization of a locking or spring ring which is provided to act as a securing device under centrifugal force. In response to the spin acting on the projectile, the spring ring will expand so as to facilitate the projectile core exiting from the sabot. The sabot possesses a high flow resistance so as to fall back during flight relative to the projectile core. Consequently, this will produce the danger of the sabot, as well as the plastic components of the projectile hood, striking against and damaging the aircraft which is firing the ammunition.

In the disclosure of German Laid-Open Patent Appln. No. 35 08 053 there is described a subcaliber-sized projectile possessing a sabot which is constituted from a plurality of segments. The sabot is dispersed or split up into its segments as a consequence of its high flow resistance, so as to cause the projectile core to be freed. When a projectile of this kind is fired from a flying aircraft, there is then encountered the danger that the aircraft will fly into the segments from the sabot.

SUMMARY OF THE INVENTION

Accordingly, it is an object of the present invention to contemplate the provision of an article of ammunition of the above-mentioned type, in which the propulsion mechanism or sabot which separates from the projectile core will not lead to any endangering of the equipment engaged in the firing.

Inventively, the foregoing object is attained for ammunition of the above-mentioned type, in that the propulsion mechanism is constructed as an inherently stable secondary projectile which flies at a readily estimatable trajectory. The propulsion mechanism continues to fly in the manner of a projectile subsequent to the separation thereof from the projectile core. Hereby, on the one hand, it is possible to ensure that an aircraft engaged in the firing cannot strike against the propulsion mechanism. On the other hand, the effectiveness of the ammunition is enhanced inasmuch as, in addition to the projectile core, the propulsion mechanism can also possess the effectiveness of a projectile. As a special advantage there is hereby ascertained that it is possible to calculate the trajectory of the propulsion mechanism. Furthermore, because of the subcaliber-sized condition of the projectile, there are attained higher impact energies and, concurrently through the shorter periods of flight, higher levels of effect in a target. The propulsion mechanism, which is in the form of a secondary projectile, can be constructed as a tubular projectile pursuant to a particular embodiment of the invention, and in which the projectile body is arranged coaxially. On the other hand, the propulsion mechanism can be constituted from a projectile core on which an effective tubular projectile is coaxially arranged.

For an article of ammunition with a securing device acting under the effects of centrifugal force, and which is arranged intermediate the propulsion mechanism and the projectile core, and which releases in response to the action of the spin, in accordance with a preferred embodiment of the invention, the centrifugally-acting securing device is constructed as a seal which is located between the tubular projectile and the projectile core. Consequently, this will eliminate the necessity for additional measures through which the projectile core which is supported within the tubular projectile is to be sealed relative to the latter, so as to thereby preclude any undesirable passage or flow of gases generated from the propellent charge between the tubular projectile and the projectile core.

BRIEF DESCRIPTION OF THE DRAWINGS

Further advantageous features and embodiments of the invention can now be readily ascertained from the following description of exemplary embodiments of the subcaliber projectile, taken in conjunction with the accompanying drawings; in which.

DETAILED DESCRIPTION

Figure 1:
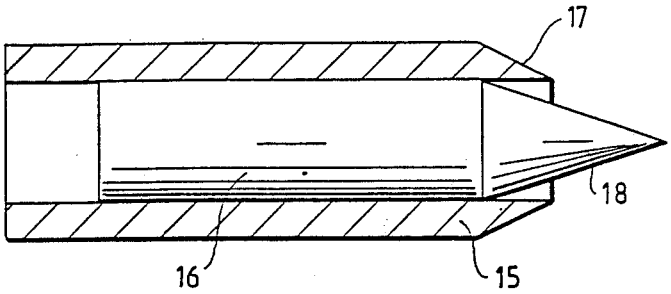
FIG. 1 illustrates, in a generally schematical longitudinal sectional view, a projectile core which is arranged within a tubular propulsion mechanism.

In accordance with FIG. 1 of the drawings, an article of ammunition is equipped with a propulsion mechanism or sabot which is configured as a tubular projectile 15, and into which there is inserted a projectile core 16. The tubular projectile 15 hereby possesses a ballistically-shaped tip 17, just as well as the projectile core 16 possesses the tip 18. Besides the projectile core 16, in this particular combination, the tubular projectile is also effective.

Figure 2:
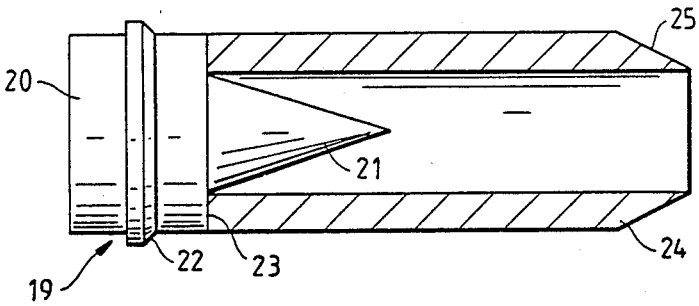
FIG. 2 illustrates in a schematically longitudinal sectional view, a tubular projectile which is arranged on a propulsion mechanism.
Figure 3:
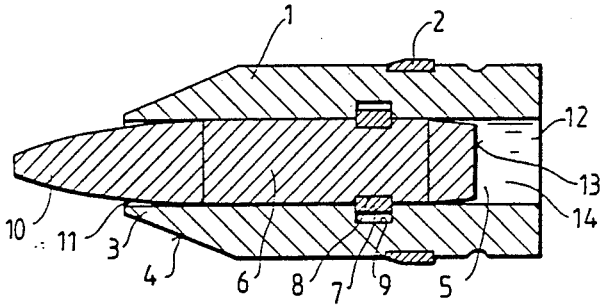
FIG. 3 illustrates a longitudinal sectional view through a projectile core which is arranged within a tubular projectile.

In the embodiment of FIG. 2 of the drawings, the propulsion mechanism 19 is constructed in the shape of a projectile core having a base member 20 with and a ballistic tip 21 being formed thereon. A guide band 22 is arranged to extend about the mantle surface of the base member 20 within an applicable annular groove. The projectile tip 21, which is somewhat smaller in diameter in comparison with that of the base member 20, provides for an open annular surface on the end surface 23 of the base member 20 for the arranging of the tubular projectile 24 which again, as heretofore, possesses a ballisticallyshaped tip 25.

A tubular projectile 1 possesses a guide band 2. The forward or leading end 3 of the tubular projectile 1 tapers down into a tip through the presence of a tapered surface 4. Slid into the cylindrical interior space 5 of the tubular projectile 1, and in a close fit therewith, is a subcaliber-sized projectile core 6.

In order to provide for the connection between the projectile core 6 and the tubular projectile 1, there is employed a locking or spring ring 7. This spring ring is partially positioned within an annular groove 8 which is formed in the projectile core 6 and partially within an annular groove 9 which is formed in the tubular projectile 1. In this manner, the spring ring 7 concurrently seals a gap which is present between the outer circumference of the projectile core 6 and the internal circumference of the tubular projectile 1.

The projectile core 6 has is conically configured head end 10 protruding beyond the forward or leading end 3 of the tubular projectile 1. In this case, it is also contemplateable to have a reverse kind of construction. A small open space 11 is arranged between the head end 10 and the forward end 3.

An open end 12 provided at the tail end of the tubular projectile 1 projects beyond a base 13 of the projectile core 6 so as to form a chamber 14 therewith.

At the firing of the ammunition, the gas which is generated from a propellent charge exerts an action against the base 13 and the tail end 12. Consequently, the spring ring 7 assumes the axial interconnection between the projectile core 6 and the tubular projectile 1. Through the intermediary of the guide band 2 a spin is imparted to the tubular projectile 1 and, as a result thereof, also to the projectile core 6.

Upon exiting from the weapon barrel, the spring ring 7 expands as a consequence of the spin, such that the projectile core 6 is axially freed from the tubular projectile 1. The projectile core 6 and the tubular projectile 1 then separate from each other due to their different resistances to airflow and because of their differing inertias.

The tubular projectile 1 also evinces a stable, spin-stabilized flying characteristic with a low CW-value at an internal flow so as to assuredly rapidly distance itself from the weapon barrel or; in essence, the aircraft which is engaged in the firing.

Through a suitable sizing of its dimensions and its mass, the tubular projectile 1 can be designed in such a manner such that it essentially assumes the same trajectory or path of flight as that of the projectile core 6. The tubular projectile 1 then comes into effect within the target of the projectile core 6.

The projectile core 6 can also be designed as an inertial projectile, as a fragment-forming projectile or as an incendiary projectile.

What is claimed is:

1. Article of ammunition, especially for utilization with cannon mounted on board aircraft; comprising a subcaliber projectile core; a tubular projectile possessing a substantially constant internal diameter coaxially arranged on said projectile core to form an inherently stable secondary projectile for the assuming of an estimatable trajectory, a head end of the projectile core protruding beyond a forward end of said secondary projectile, said tubular projectile having an open tail end projecting beyond the trailing end of said projectile core to provide a rearwardly opening chamber for the receipt of gases generated by a propellent charge and to exert a propulsive force against said projectile core and said tubular projectile in the direction of firing thereof, the forward end of the tubular projectile being tapered down by a taper surface to form a conical leading end portion an open space intermediate the forward end of the tubular projectile and the head end of the projectile core; and spring ring securing means responsive to centrifugal force being arranged in aligned circumferential grooves intermediate said tubular projectile and said projectile core, said spring ring securing means forming a seal intermediate said tubular projectile and said projectile core to inhibit the passage of gases therebetween, and upon firing of said projectile, being radially outwardly expandable within said grooves responsive a spin of said projectile so as to release the engagement between said projectile core and said tubular projectile.

2. Ammunition as claimed in claim 1, wherein the projectile core comprises an elongated projectile.

* * * * *